US009287037B2

(12) United States Patent
Kajiyama

(10) Patent No.: US 9,287,037 B2
(45) Date of Patent: Mar. 15, 2016

(54) TRANSFORMER-BOBBIN AND TRANSFORMER

(71) Applicant: Sumida Corporation, Chuo-ku, Tokyo (JP)

(72) Inventor: Tomohiro Kajiyama, Natori (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 14/694,490

(22) Filed: Apr. 23, 2015

(65) Prior Publication Data

US 2015/0332843 A1 Nov. 19, 2015

(30) Foreign Application Priority Data

May 15, 2014 (JP) ..... 2014-101207

(51) Int. Cl.

| | |
|---|---|
| ***H01F 27/30*** | (2006.01) |
| ***H01F 27/34*** | (2006.01) |
| ***H01F 27/32*** | (2006.01) |
| ***H01F 5/00*** | (2006.01) |

(52) U.S. Cl.

CPC ..... *H01F 27/34* (2013.01); *H01F 5/00* (2013.01); *H01F 27/30* (2013.01); *H01F 27/325* (2013.01)

(58) Field of Classification Search

CPC ..... H01F 5/00; H01F 27/00–27/30
USPC ..... 336/65, 83, 196, 198, 200, 232
See application file for complete search history.

(56) References Cited

U.S. PATENT DOCUMENTS

2012/0320505 A1* 12/2012 Lee ..... H01F 27/346 361/679.01
2013/0002386 A1* 1/2013 Park ..... H01F 27/2828 336/192
2013/0002390 A1* 1/2013 Nam ..... H01F 27/325 336/207

FOREIGN PATENT DOCUMENTS

JP 06-031125 U 4/1994

* cited by examiner

*Primary Examiner* — Tuyen Nguyen
(74) *Attorney, Agent, or Firm* — Harness, Dickey & Pierce, P.L.C.

(57) ABSTRACT

A transformer-bobbin including a winding-frame portion constituted by a middle barrel portion 63, a lower flange portion 62 and an upper flange portion 61, wherein there is provided a slit portion 67 which notches the terminal bed unit 65 and the lower flange portion 62 and concurrently which extends in the centrally approaching and separating direction toward the middle barrel portion 63 side, and wherein at the slit portion 67, there is provided a guide wall surface 68*a* whose side on the middle barrel portion 63 side is positioned on the lower flange portion side compared with whose side apart from the middle barrel portion 63.

13 Claims, 9 Drawing Sheets

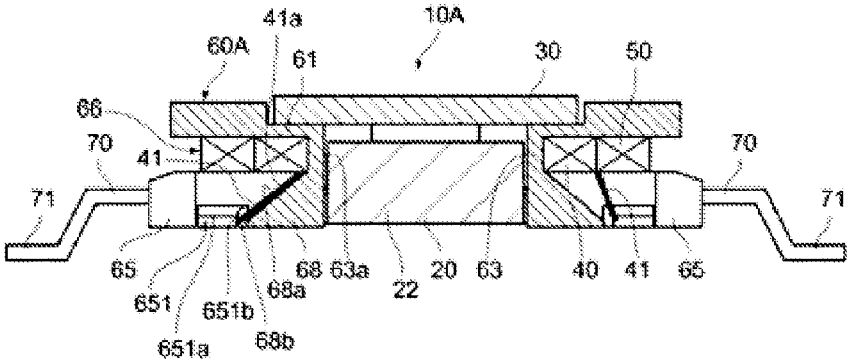
FIG. 2
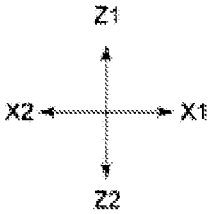

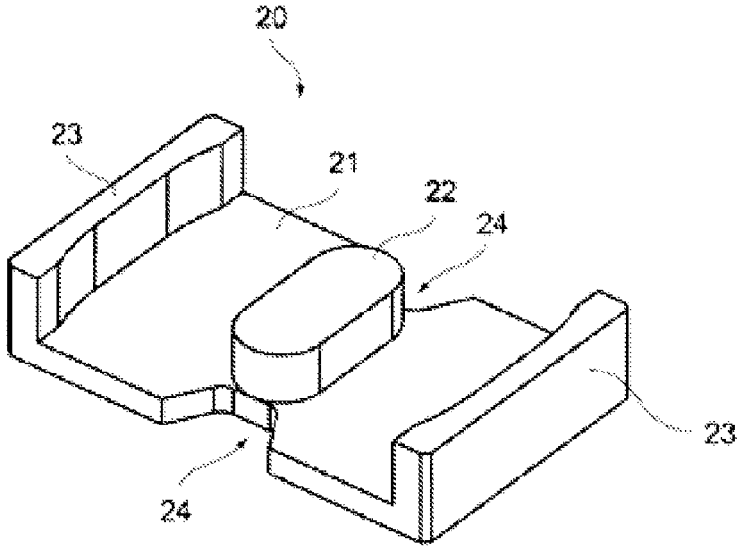
FIG. 3
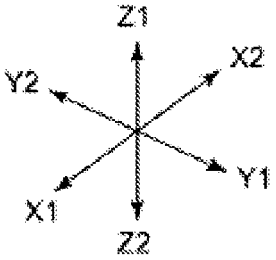

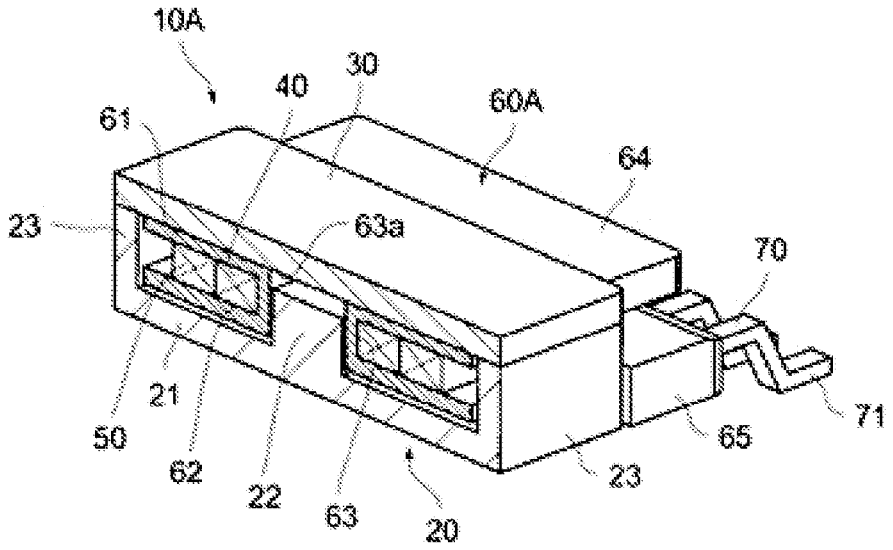
FIG. 4
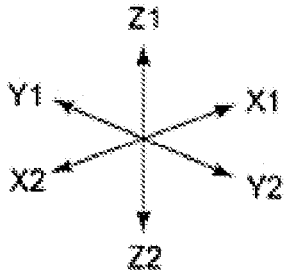

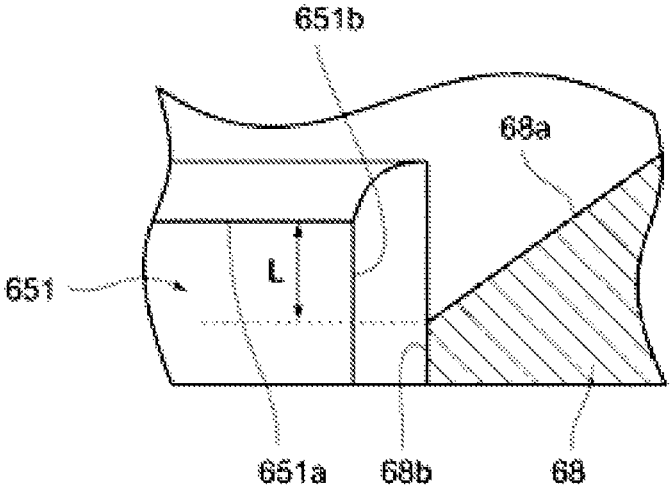
FIG. 7
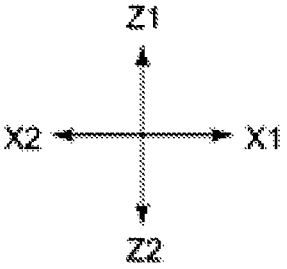

TRANSFORMER-BOBBIN AND TRANSFORMER

CROSS REFERENCES TO RELATED APPLICATIONS

The present invention contains subject matter related to Japanese Patent Application JP2014-101207 filed in the Japanese Patent Office on May 15, 2014, the entire contents of which being incorporated herein by reference.

BACKGROUND OF THE INVENTION

1. Field of the Invention

The present invention relates to a transformer-bobbin for a transformer used in a wide variety of electronic equipment and relates to a transformer.

2. Description of the Related Art

In the wide variety of transformers, there exists a transformer having a constitution as shown in a Patent Document 1 (Japanese unexamined Utility-Model publication No. H6-31125). In the Patent Document 1, there is disclosed a transformer in which a primary winding and a secondary winding are wound concentrically. Specifically, for a bobbin 10, there are provided a base unit 11 which is buried with a terminal 20 and a cylinder-shaped winding-axis 12 which protrudes upward from the base unit 11. In this Patent Document 1, there is employed a constitution in which the primary winding (inside winding-wire 30) is arranged on the winding-axis 12 by arranging a lead wire on the lower side of the bobbin 10 through a slit 14 and by applying the winding around winding-axis 12 after the arrangement thereof.

SUMMARY OF THE INVENTION

Incidentally, the configuration disclosed in the Patent Document 1 is not preferable, because there is a case in which an electric discharge or the like occurs when the winding start side and the winding end side of the primary winding are arranged in a state adjacent to the secondary winding. For this reason, it is usually employed a configuration in which the winding start side of the primary winding is arranged so as to be apart from the secondary winding side by being disposed along the most bottom side of the bobbin 10 or along a near portion thereof. In that case, there is obtained such an arrangement in which the winding start side of the primary winding goes along the winding-axis 12 upward from the lower end side of the cylinder-shaped winding-axis 12 of the bobbin 10.

However, in case of employing such an arrangement, it becomes a state in which the winding start side of the primary winding will be positioned close to the E-shaped core 70. In that case, it becomes a state in which the winding start side of the primary winding is positioned with respect to the E-shaped core 70 by being apart merely as much as the thickness of the cylinder-shaped winding-axis 12. Then, it becomes a state in which the winding start side of the primary winding comes too close to the E-shaped core 70 and there may be a case in which electric discharge or the like occurs.

The present invention was invented in view of such a problem and is addressed to provide a transformer-bobbin and a transformer having configurations in which it is possible to make the terminal end on the winding start side of the primary winding apart from the core center-leg portion.

A transformer-bobbin of the present invention is characterized by including: a middle barrel portion having an insertion hole through which a core unit is inserted; a lower flange portion which is provided by protruding toward a direction apart from the axis-line center of the middle barrel portion and concurrently which is positioned on a side, within the middle barrel portion, that is mounted on a mounting substrate; an upper flange portion which is provided by protruding toward a direction apart from the axis-line center of the middle barrel portion and concurrently which is positioned on a side, within the middle barrel portion, that is apart from the mounting substrate; and a terminal bed unit which is provided integrally or separately with the lower flange portion and concurrently which supports the terminal member, and further comprising: a winding-frame portion constituted by the middle barrel portion, the lower flange portion and the upper flange portion, wherein there is provided a slit portion which notches the terminal bed unit and the lower flange portion and concurrently which extends in the centrally approaching and separating direction toward the middle barrel portion side, and wherein at the slit portion, there is provided a guide wall surface whose side on the middle barrel portion side is positioned on the lower flange portion side compared with whose side apart from the middle barrel portion.

Also, in addition to the above-mentioned invention, it is preferable that another aspect of the present invention further provides a transformer-bobbin in which on the guide wall surface, there is provided a guide wall portion which protrudes toward the mounting substrate side compared with the lower flange portion.

Further, in addition to the above-mentioned inventions, it is preferable that another aspect of the present invention further provides a transformer-bobbin in which on the facing-surface side which faces to the mounting substrate within the terminal bed unit, there is provided a guide groove portion which recesses, compared with the facing-surface, toward the side apart from the mounting substrate and concurrently which is for guiding the conductive wire wound around the winding-frame portion to the terminal member.

Also, in addition to the above-mentioned inventions, it is preferable that another aspect of the present invention further provides a transformer-bobbin in which the outer end portion which is an end portion apart from the middle barrel portion in the centrally approaching and separating direction within the guide wall surface is positioned on the mounting substrate side compared with the position of the groove bottom-surface of the guide groove portion in the substrate approaching and separating direction apart from the mounting substrate.

Further, in addition to the above-mentioned inventions, it is preferable that another aspect of the present invention further provides a transformer-bobbin in which on the side apart from the middle barrel portion within the guide wall portion, there is provided an outside straight wall surface which extends in the substrate approaching and separating direction apart from the mounting substrate and concurrently which is connected with the outer end portion, in which the position of the end portion side which is apart from the mounting substrate in the substrate approaching and separating direction within the outside straight wall surface is positioned on the mounting substrate side compared with the position of the groove bottom-surface of the guide groove portion in the substrate approaching and separating direction, and in which in addition, the position of the outside straight wall surface in the centrally approaching and separating direction is faced to the slit portion within the guide groove portion and also is positioned on the middle barrel portion side compared with the position of the corner portion on the middle barrel portion side.

Also, in addition to the above-mentioned inventions, it is preferable that another aspect of the present invention further provides a transformer-bobbin in which the distance in the approaching and separating direction of the substrate is a distance lying between the position on the end portion side apart from the mounting substrate and the position of the groove bottom-surface of the guide groove portion within the outside straight wall surface and is set as one to three times of the diameter of the conductive wire.

Further, in addition to the above-mentioned inventions, it is preferable that another aspect of the present invention further provides a transformer-bobbin in which the inner end portion on the middle barrel portion side within the guide wall surface is apart from the winding-frame portion side within the lower flange portion and concurrently, between the inner end portion and the winding-frame portion side of the lower flange portion, there exists an inside straight wall surface along the outer surface of the middle barrel portion.

Also, it is preferable that another aspect of the present invention provides a transformer which uses a transformer-bobbin relating to each invention described above and concurrently which includes a primary winding which is arranged at the winding-frame portion and concurrently which is positioned on the middle barrel portion side, and a secondary winding which is arranged at the winding-frame portion and concurrently which is positioned on the outside of the primary winding.

According to the present invention, it becomes possible to make the terminal end on the winding start side of the primary winding apart from the core center-leg portion.

BRIEF DESCRIPTION OF THE DRAWINGS

FIG. 2 is a cross-sectional side view showing a constitution of the transformer in FIG. 1;

FIG. 3 is a perspective view showing a shape of an E-shaped core of the transformer in FIG. 1;

FIG. 4 is a perspective view of a half cross-sectional state showing a state of cutting-off the transformer in FIG. 1 by a YZ plane surface at the center in the X-direction;

FIG. 7 is a partial cross-sectional view showing a positional relationship between the guide groove portion of the transformer in FIG. 1 and the outer end portion side of the guide wall surface by being enlarged;

DESCRIPTION OF THE PREFERRED EMBODIMENTS

First Exemplified Embodiment

Hereinafter, a transformer 10A and a transformer-bobbin 60A relating to a first exemplified embodiment of the present invention will be explained with reference to the drawings.

It should be noted that in the explanation hereinafter, there are sometimes cases in which the explanation is carried out by using XYZ orthogonal coordinate system. In those cases, the X-direction is made to indicate a direction for connecting a pair of terminal bed units 65 within the transformer-bobbin 60A, in which X1 side thereof is made to be the right-near side in FIG. 1 and X2 side thereof is made to be the left-rear side in FIG. 1. In addition, the Y-direction is made to indicate a direction perpendicular to the X-direction and concurrently a longitudinal direction of an E-shaped core 20 and a lid core 30, in which Y1 side thereof is made to be the right-rear side in FIG. 1 and Y2 side thereof is made to be the left-near side in FIG. 1. In addition, the Z-direction is made to indicate a thickness direction of the transformer 10A, in which Z1 side thereof is made to be the upper side in FIG. 1 and Z2 side thereof is made to be the lower side in FIG. 1.

<With Regard to the Whole Constitution of Transformer 10A>

Figure 1:
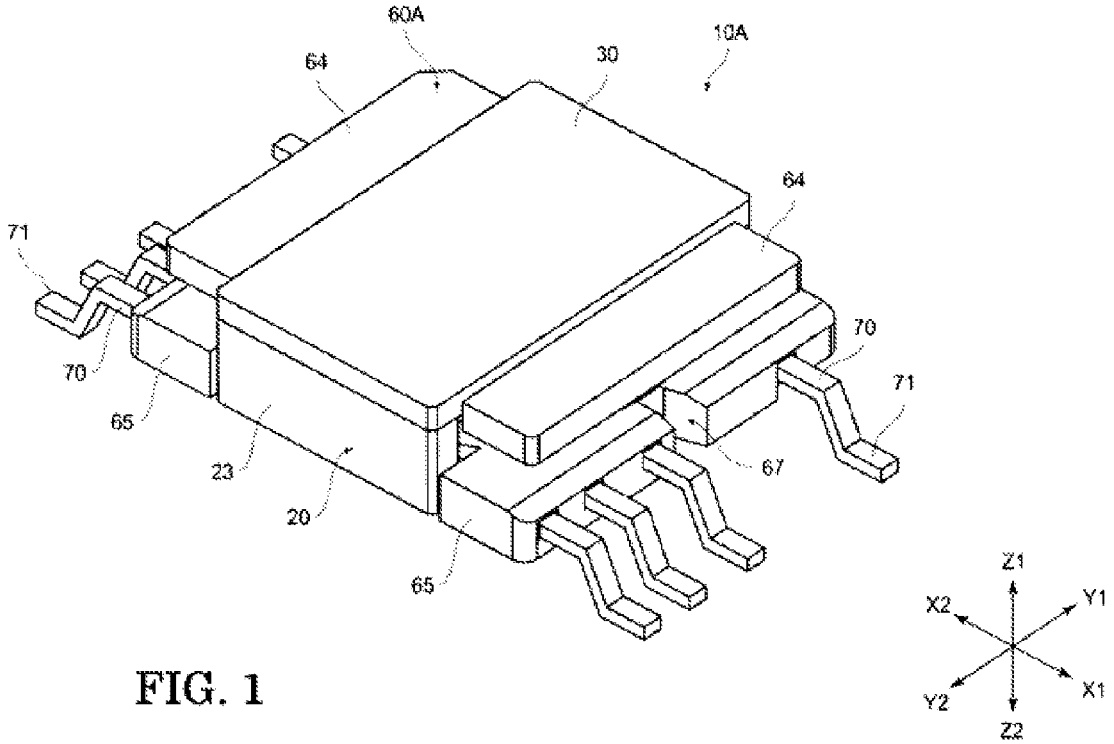
FIG. 1 is a perspective view showing a whole constitution of a transformer relating to a first exemplified embodiment.

FIG. 1 is a perspective view showing a whole constitution of the transformer 10A. FIG. 2 is a cross-sectional side view showing a constitution of the transformer 10A. As shown in FIG. 1 and FIG. 2, the transformer 10A includes an E-shaped core 20, a lid core 30, a primary winding 40 and a secondary winding 50, and those elements are mounted on the transformer-bobbin 60A.

As shown in FIG. 1 and FIG. 2, the E-shaped core 20 is positioned on the lower side (Z2 side) compared with the lid core 30. FIG. 3 is a perspective view showing the shape of the E-shaped core 20. FIG. 4 is a perspective view in a half cross-sectional state showing a state of cutting-off the transformer 10A by a YZ plane surface at the center thereof in the X-direction. As shown in FIG. 3 and FIG. 4, the E-shaped core 20 includes a core bottom portion 21, a core center-leg portion 22 and a core end surface portion 23, in which the core 20 is provided such that the shape thereof when seen from the side becomes an E-shape. Within those respective elements, the core bottom portion 21 is provided to be long in the Y-direction and is provided such that the core center-leg portion 22 is directed toward the upper side (Z1 side) at the center portion in the longitudinal direction (Y-direction) of that core bottom portion 21.

In addition, the core center-leg portion 22 is provided to be long toward the short direction (X-direction) of the E-shaped core 20 compared with toward the longitudinal direction (Y-direction) of the E-shaped core 20. By employing this configuration, the primary winding 40 is arranged on the outer circumferential side of the core center-leg portion 22 through a middle barrel portion 63 of the transformer-bobbin 60A and further, the secondary winding 50 is arranged on the outside of that primary winding 40. It should be noted that core center-leg portion 22 corresponds to the core unit.

In addition, as shown in FIG. 3 and FIG. 4, the core end surface portions 23 are provided respectively on both the end sides in the longitudinal direction (Y-direction) of the E-shaped core 20. These core end surface portions 23 protrude so as to be directed from the core bottom portion 21 toward the upper side (Z1 side). In addition, the core end surface portions 23 are provided by extending over the whole core bottom portion 21 in the width direction (X-direction). However, the inner circumferential wall portion of the each core end surface portion 23 is not provided in a planar shape but is provided in such a shape that the end portion side protrudes toward the center side a little bit compared with the center side in the width direction (X-direction) of the inner circumferential wall portion thereof and depending on this configuration, it is attempted to reduce the gap with respect to the secondary winding 50.

In addition, cut-out portions 24 are provided at the center portion in the longitudinal direction (Y-direction) of the core bottom portion 21. The cut-out portions 24 are portions obtained by notching the aforesaid core bottom portion 21 along the width direction (X-direction) of the core bottom portion 21 and are portions which are recessed so as to be directed from both the end sides in the width direction (X-direction) toward the core center-leg portion 22. At these cut-out portions 24, there are positioned guide wall portions 68 for guiding conductive wires to the middle barrel portion 63 of the transformer-bobbin 60A, which will be mentioned later.

Here, it is preferable that the center portion of the core center-leg portion 22 in the Y-direction and the center portion of the cut-out portion 24 in the Y-direction are positioned on the same line in the up and down direction (Z-direction) as shown in FIG. 2. More specifically, in a case in which the cut-out portion 24 side is formed so as to bite into the core center-leg portion 22 without being a flush surface as mentioned above, it becomes a state in which the cross-sectional area of the magnetic-path at the core center-leg portion 22 will be reduced. In addition, in a case in which the cut-out portion 24 side does not bite into the core center-leg portion 22 and the recess of the cut-out portion 24 is small without being a flush surface as mentioned above, it becomes a state in which a guide wall portion 68 described later will be thin-walled. However, in a case in which the center portion of the core center-leg portion 22 in the Y-direction and the center portion of the cut-out portion 24 in the Y-direction are positioned on the same line in the up and down direction (Z-direction) as shown in FIG. 2, the cross-sectional area of the magnetic-path at the core center-leg portion 22 is never reduced and also, it is possible to maximize the thickness of a guide wall portion which will be described later. In addition, it is possible to design the inner wall side of the middle barrel portion 63 of the transformer-bobbin 60A to be flush and it becomes easy to carry out the manufacturing of the transformer-bobbin 60A.

It should be noted that as shown in FIG. 2, in order to prevent magnetic saturation, the heights of the upper end surfaces of the core end surface portions 23 are provided to be higher than the height of the upper end surface of the core center-leg portion 22. Therefore, it is preferable to employ a constitution in which the core end surface portions 23 abut the lid core 30 but the core center-leg portion 22 does not abut the lid core 30. However, so long as a large electric current is not used and therefore there is no worry about a magnetic saturation, it is allowed to employ a configuration in which the heights of the upper end surfaces of the core end surface portions 23 are made to have same height as the height of the upper end surface of the core center-leg portion 22.

In addition, in order to prevent the magnetic saturation, it is allowed to provide each of the heights of the upper end surfaces of the core end surface portions 23 to be lower than the height of the upper end surface of the core center-leg portion 22. At that time, there are formed total two gaps between the respective core end surface portions 23 and the lid core 30. Therefore, there can be obtained such a feature that it is hard for the magnetic saturation to occur even if a large electric current flows. It is needless to say that these gaps may be air gaps or may be gaps formed by using spacers composed of materials which are nonmagnetic and also nonconductive bodies. In case of using spacers, it is possible to accurately define the position between the lid core 30 and the core center-leg portion 22 of the E-type core 20 compared with the air gaps, and further, it is possible to eliminate such a problem that the lid core 30 wobbles with respect to the E-type core 20. It should be noted that in case of using spacers, it is allowed to employ a configuration in which a gap is formed between the core center-leg portion 22 and the lid core 30.

Further, it is allowed to use a single sheet of flat plate-shaped spacer in order that it is possible to achieve miniaturization of the transformer 10A relating to this exemplified embodiment. In this case, there will be employed a configuration in which that spacer is provided between the lid core 30 and the E-type core 20. Then, the upper surface of that spacer comes in contact with the lower surface of the lid core 30, and also, the lower surface of that spacer comes in contact with the upper end surface of the core center-leg portion 22 of the E-type core 20 and the upper end surfaces of the core end surface portions 23. According to this structure, even if the area of the upper end surface of the core center-leg portion 22 or the areas of the upper end surfaces of the core end surface portions 23 become small along with the miniaturization of the transformer 10A of this exemplified embodiment, it is possible to form accurate magnetic gaps. Here, it is allowed to select a configuration in which the plate thicknesses of the spacer are changed between for the positions at which the core end surface portions 23 contact and for the position at which the core center-leg portion 22 contacts, but it is also allowed to select a configuration of the same plate thicknesses.

In addition, the lid core 30 is a plate shaped core member as shown in FIG. 1 and FIG. 2, in which the lid core abuts the core end surface portions 23 of the E-type core 20. Then, the lid core 30 is faced to the core center-leg portion 22 by including a gap for preventing magnetic saturation. However, so long as a large electric current is not used and therefore, so long as there is no worry about the magnetic saturation, it is allowed to employ a constitution in which the lid core 30 abuts the core center-leg portions 22 directly.

In addition, an example of air gaps is shown in FIG. 2, but in order to accurately define the positions of the lid core 30 and the core center-leg portion 22 of the E-type core 20 and further in order to eliminate such a problem that a wobbling occurs, it is also possible to use spacers composed of materials which are nonmagnetic and also nonconductive bodies. In this case, it is possible, for example, to use a column-shaped member having a predetermined height, which is formed from epoxy resin.

It should be noted with regard to the E-type core 20 and the lid core 30 that the materials thereof are made to be magnetic materials, in which for the magnetic materials, it is possible, for example, to use wide variety of magnetic materials such as various kinds of ferrites of nickel-based ferrite, manganese-based ferrite and the like; permalloy; sendust; and the like, and to use mixtures of the wide variety of magnetic materials.

Next, the primary winding 40 and the secondary winding 50 will be explained. The primary winding 40 is formed by starting the winding in a state in which the winding start side of the conductive wire 41 (see FIG. 2) is made in contact with the middle barrel portion 63 of the transformer-bobbin 60A mentioned later. Then, caused by the winding progress of the conductive wire 41, the primary winding 40 becomes a state in which the conductive wire 41 is laminated as much as a plurality of layers toward the outer circumferential side. Therefore, the winding end side of the primary winding 40 is positioned on the outer circumferential side compared with the winding start side.

In addition, the secondary winding 50 is formed by starting the winding in a state in which the winding start side of the conductive wire 41 is made in contact with the outer circumference of primary winding 40. Then, caused by the winding progress of the conductive wire 41, also the secondary winding 50 becomes a state in which the conductive wire 41 is laminated as much as a plurality of layers toward the outer circumferential side and the winding end side thereof is positioned on the outer circumferential side compared with the winding start side. Then, between these of the primary winding 40 and the secondary winding 50, it is made possible to convert the voltage by using electromagnetic induction.

<With Regard to Transformer-Bobbin 60A>

Figure 5:
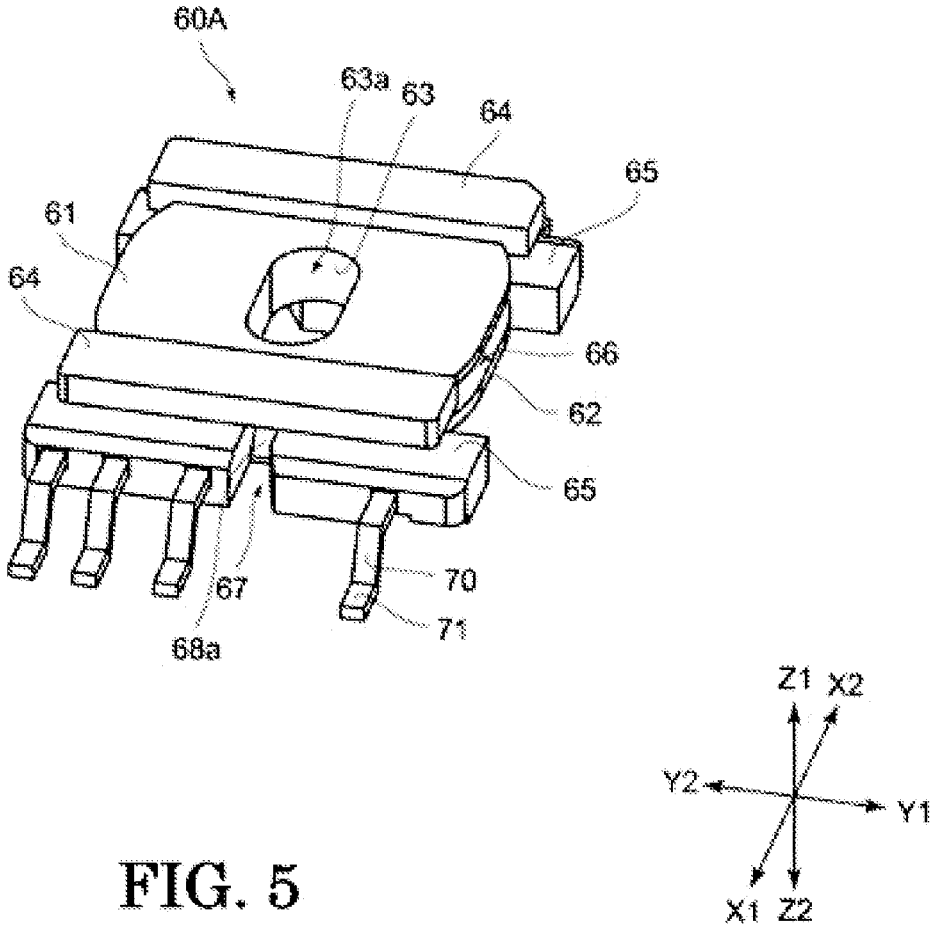
FIG. 5 is a perspective view showing a constitution when seeing a transformer-bobbin of the transformer in FIG. 1 from the upper side.
Figure 6:
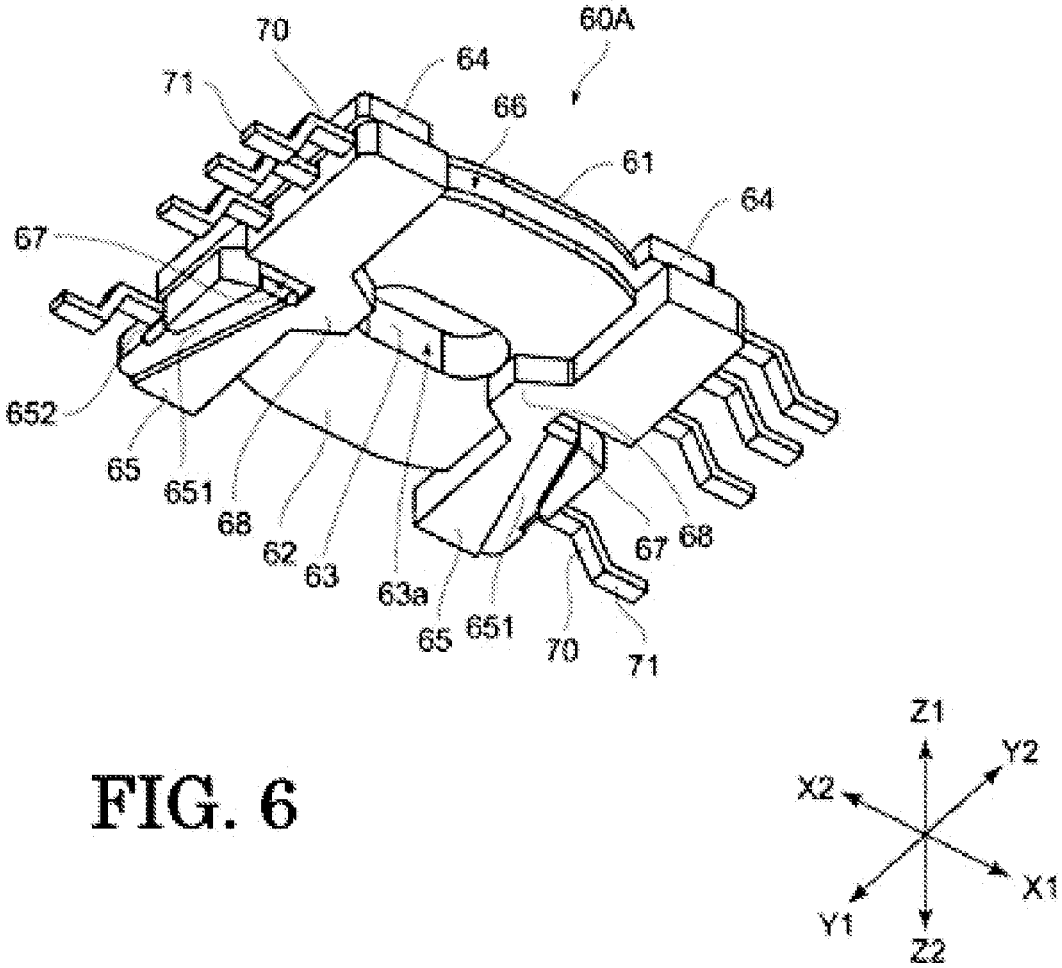
FIG. 6 is a perspective view showing a state when seeing the transformer-bobbin of the transformer in FIG. 1 from the lower side.

Next, the transformer-bobbin 60A will be explained. FIG. 5 is a perspective view showing a constitution when seeing the transformer-bobbin 60A from the upper side. FIG. 6 is a perspective view showing a state when seeing the transformer-bobbin 60A from the lower side. The transformer-bobbin 60A is formed by insert molding which arranges the terminal members 70 inside the mold and injects a melted resin. However, it is allowed for the transformer-bobbin 60A to be formed in a shape having hole portions beforehand for plugging-in the terminal members 70 and to be formed without carrying out the insert molding. As shown in FIG. 2, FIG. 5 and FIG. 6, the transformer-bobbin 60A includes an upper flange portion 61, a lower flange portion 62, a middle barrel portion 63, upward latch portions 64, and terminal bed units 65.

The upper flange portion 61, the lower flange portion 62 and the middle barrel portion 63 constitute a winding-frame portion 66 at which the primary winding 40 and the secondary winding 50 are positioned. Within these components, the upper flange portion 61 is a flange-shaped portion which is positioned on the upper side within the winding-frame portion 66. In addition, the lower flange portion 62 is a flange-shaped portion which is positioned on the lower side within the winding-frame portion 66. It should be noted that the upper flange portion 61 and the lower flange portion 62 protrude toward a direction apart from the axis-line center of the middle barrel portion 63.

In addition, the middle barrel portion 63 is a barrel-shaped portion which couples the upper flange portion 61 and the lower flange portion 62 within the winding-frame portion 66. Then, on the inner circumferential side of this middle barrel portion 63, there is provided an insertion hole 63*a* and the core center-leg portion 22 of the E-type core 20 is inserted through that insertion hole 63*a*. In addition, on the outer circumferential side of the middle barrel portion 63, there are arranged the primary winding 40 and the secondary winding 50. It should be noted in this exemplified embodiment that the middle barrel portion 63 is provided such that the shape thereof when seen planarly is an extended elliptical shape.

In addition, the upward latch portions 64 are portions which protrude from both the end sides in the X-direction of the upper flange portion 61 toward the upper side (Z1 side). As shown in FIG. 1, FIG. 2 and FIG. 4, on the upper side (Z1 side) of the upper flange portion 61, the lid core 30 is positioned, in which in order to carry out the positioning of that lid core 30 in the width direction (Y-direction), there is provided the upward latch portion 64. It should be noted that as shown in FIG. 5 and FIG. 6, the outer peripheral portions of the upper flange portion 61 and the lower flange portion 62 are curved so as to follow the primary winding 40 and the secondary winding 50. However, for the relation of carrying out the positioning of the lid core 30, the upward latch portions 64 are provided to be in rectangular shapes which are long in the Y-direction.

In addition, the terminal bed units 65 are portions which protrude from both the end sides in the X-direction of the lower flange portion 62 toward the lower side (Z2 side). Portions of the plurality of terminal members 70 are inserted into these terminal bed units 65. The terminal member 70 is made of metal and it is made possible to obtain electrical connection with respect to the aforesaid conductive wire 41 by binding the terminal end (including start terminal end 41*a*) of the conductive wire 41 onto the root side of the terminal bed unit 65. In addition, on the lower side of the terminal member 70, there is provided a mounting terminal portion 71 and this mounting terminal portion 71 is connected electrically with an external mounting substrate or the like.

Here, as shown in FIG. 6, there are provided guide groove portions 651 on the lower sides of the terminal bed units 65. The guide groove portion 651 is a portion which is recessed so as to be directed from the lower surface (facing-surface) side of the terminal bed unit 65 toward the upper side as much as a predetermined depth. This guide groove portions 651 is provided so as to stride from a slit portion 67 positioned at the center in the Y-direction to the end portion on the Y1 side of the terminal bed unit 65. In addition, the guide groove portion 651 reaches the root portion of the terminal member 70 on the Y1 side. There is provided an inclination portion 652 between the guide groove portion 651 and the root portion of the terminal member 70 on the Y1 side. For this reason, it becomes possible to guide the terminal end of the conductive wire 41, which is to be bound around the terminal member 70 on the Y1 side, more favorably.

In addition, there are provided slit portions 67 at the center portions in the longitudinal direction (Y-direction) of the lower flange portion 62 and the terminal bed units 65. The slit portion 67 is a portion obtained by notching the terminal bed unit 65 so as to be directed from the outside in the X-direction toward the middle barrel portion 63 side (center side of the transformer-bobbin 60A) within the terminal bed unit 65. In addition, the slit portion 67 is connected with the guide groove portion 651 described above. It should be noted that the X-direction toward which the slit portion 67 extends corresponds to the centrally approaching and separating direction.

As shown in FIG. 2, there are provided guide wall portions 68 on the rear sides (center side of the transformer-bobbin 60A) of the slit portions 67 within the transformer-bobbin 60A. As shown in FIG. 6, the guide wall portions 68 are positioned on the insertion hole 63*a* side compared with the terminal bed units 65 within the transformer-bobbin 60A and these guide wall portions 68 form portions which are positioned at the cut-out portions 24 of the E-type core 20. More specifically, the guide wall portion 68 protrudes toward the lower side compared with the lower flange portion 62. In addition, at the guide wall portions 68, there are provided such a taper-shaped guide wall surfaces 68*a* which are directed upward as being directed from the outsides of the terminal bed units 65 within the transformer-bobbin 60A toward the center side of the transformer-bobbin 60A.

Here, as shown in FIG. 2, the proximal end on the middle barrel portion 63 side (that is, upper side) of the guide wall surface 68*a* becomes the corner portion on the inner circumferential side of the winding-frame portion 66 or the vicinity thereof. Therefore, the terminal end (which is named as start terminal end 41*a*) on the winding start side of the primary winding 40 is apart from the core center-leg portion 22, which is positioned in the insertion hole 63*a*, by means of the guide wall surface 68*a* at the position on the lower side before entering into the winding-frame portion 66. More specifically, by supporting the start terminal end 41 of the primary winding 40 by the guide wall surface 68*a*, the start terminal end 41*a* thereof is prevented from approaching to the core center-leg portion 22. In particular, even in a state in which the start terminal end 41*a* is maintained to be loosened, the start terminal end 41*a* is prevented from approaching to the core center-leg portion 22 by the guide wall surface 68*a*. Therefore, for the position on the lower side compared with the winding-frame portion 66, it becomes possible to prevent the occurrence of the defect of electric discharge or the like such as in a case in which the start terminal end 41*a* is arranged in close to the core center-leg portion 22.

However, when it becomes a state in which the start terminal end 41*a* is arranged to be close to the secondary winding 50, it will cause a state in which a defect such as electric discharge or the like occurs between the start terminal end 41*a* and the secondary winding 50. Therefore, the guide wall surface 68*a* has a sufficient inclination angle with respect to the horizontal direction (X-direction in FIG. 2) so as to be apart from the secondary winding 50 and even in case of supporting the start terminal end 41*a*, the constitution thereof makes the start terminal end 41*a* thereof possible to be apart from the secondary winding 50 sufficiently. It should be noted that for one example of the inclination angle of the guide wall surface 68*a*, it is possible to be set, for example, as degrees, in which it is preferable to be set as an arbitrary inclination angle between 30 degrees to 60 degrees.

In addition, for the guide wall portion 68, there is also provided an outside straight wall surface 68*b* other than the guide wall surface 68*a*. The outside straight wall surface 68*b* is provided so as to be continuous with the end portion (outer end portion) on the outside which is apart from the guide wall surface 68*a* within the insertion hole 63*a*. In addition, the outside straight wall surface 68*b* is provided so as to extend along the up and down direction (Z-direction). The outside straight wall surface 68*b* is provided not to be appreciably long and it is allowed to employ a constitution in which this outside straight wall surface 68*b* is eliminated.

FIG. 7 is a partial cross-sectional view showing a positional relationship between the guide groove portion 651 and the outer end portion of the guide wall surface 68*a* (end portion on the side apart from the middle barrel portion 63) by being enlarged. As shown in FIG. 2 and FIG. 7, the height position on the upper end side of the outside straight wall surface 68*b* is provided so as to become lower as long as a distance-L which is at least longer than the diameter of the start terminal end 41*a* with respect to the height position of the groove bottom-surface 651*a* of the guide groove portion 651. In addition, the outside straight wall surface 68*b* is positioned on the inside (insertion hole 63*a* side) compared with the corner portion 651*b*. Therefore, for the start terminal end 41*a*, the corner portion 651*b* on the inside (insertion hole 63*a* side) of the position which is opened at the slit portion 67 within the guide groove portion 651 is made to be its bending position. More specifically, the corner portion 651*b* becomes a hooking position of the start terminal end 41*a*.

In addition, by providing the outside straight wall surface 68*b* and the corner portion 651*b*, which have a positional relationship as mentioned above, it is possible to employ a constitution in which the start terminal end 41*a* is bent comparatively gently in the vicinity of the corner portion 651*b*. Therefore, in comparison with, for example, a constitution or the like in which the height position on the upper end side of the outside straight wall surface 68*b* is higher than the height position of the groove bottom-surface 651*a*, it is possible to prevent a rapidly-bent place from being formed at the start terminal end 41*a* and it becomes possible to prevent disconnection or the like of the start terminal end 41*a* from occurring.

It should be noted that it is preferable for the height position on the upper end side of the outside straight wall surface 68*b* to be lower as much as one to three times of the diameter of the start terminal end 41*a* with respect to the height position of the groove bottom-surface 651*a* of the guide groove portion 651 and it is more preferably to be lower as much as around two-times.

Figure 8:
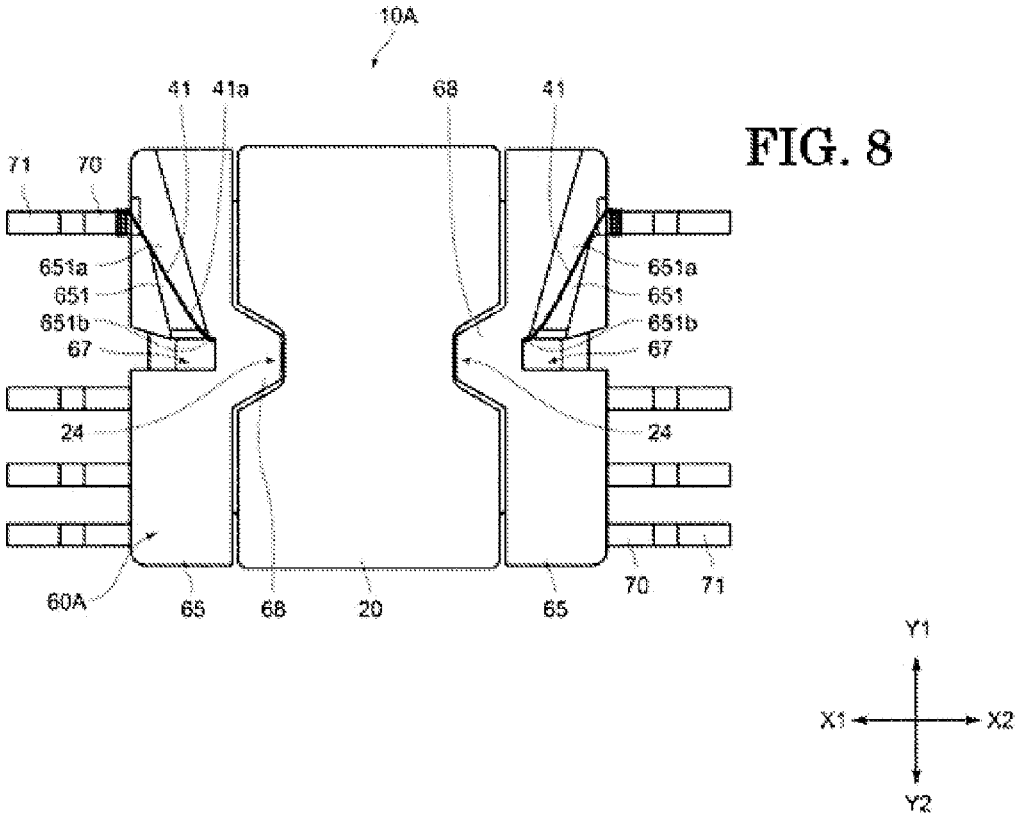
FIG. 8 is a bottom plan view showing a state of seeing the transformer in FIG. 1 from the bottom side.

FIG. 8 is a bottom plan view showing a state of seeing the transformer 10A from the bottom side. As shown in FIG. 8, the corner portion 651*b* is provided so as to be apart from the E-type core 20. Furthermore, the guide groove portions 651 are provided so as to be directed toward both the end sides in the X-direction as going toward the Y1 sides from the corner portions 651*b*. Therefore, even if the conductive wire 41 such as the start terminal end 41*a* or the like is positioned at the guide groove portion 651, it is constituted such that it is possible for the conductive wire 41 thereof to be apart as much as isolation distance or more with respect to the E-type core 20.

In the transformer 10A having such a constitution as described above, in case of forming the primary winding 40, the start terminal end 41*a* is introduced into the winding-frame portion 66 through the slit portion 67, in which after forming the primary winding 40, the start terminal end 41*a* becomes a state of being positioned in the vicinity of the boundary between the middle barrel portion 63 and the guide wall surface 68*a*. In addition, the start terminal end 41*a* positioned at the slit portion 67 is introduced into the guide groove portion 651 through the corner portion 651*b*, in which the start terminal end 41*a* thereof is bound around the terminal member 70 on the Y1 side after passing through the inclination portion 652. It should be noted that it is allowed for the binding of the start terminal end 41*a* around the terminal member 70 to be carried out before the formation of the primary winding 40 and it is also allowed to be carried out after the formation of the primary winding 40.

Here, even if the start terminal end 41*a* positioned at the slit portion 67 is loosened, the start terminal end 41*a* is prevented, owing to the guide wall surface 68*a*, from going toward the lower side over this guide wall surface 68*a*. Therefore, it is made possible to separate the start terminal end 41*a* apart from the core center-leg portion 22. In addition, even if the start terminal end 41*a* is loosened at the slit portion 67, the start terminal end 41*a* is prevented from approaching to the secondary winding 50.

It should be noted that in a state in which the start terminal end 41*a* is not loosened and the start terminal end 41*a* thereof is applied with tension, the start terminal end 41*a* exists over the area between the corner portion 651*b* and the vicinity of the boundary of the middle barrel portion 63 and the guide wall surface 68*a*, and in this case, it becomes a state in which the start terminal end 41*a* is not in contact with the guide wall surface 68*a* appreciably.

<With Regard to the Effects>

According to the transformer-bobbin 60A and the transformer 10A using this transformer-bobbin 60A, which have the constitutions as described above, there are provided slit portions 67 for the transformer-bobbin 60A and for each of the slit portions 67 thereof, there is provided a guide wall surface 68*a* in which the side of the middle barrel portion 63 side is positioned on the upper side (Z1 side) compared with the opposite side (outside) thereto. Therefore, the start terminal end 41*a* of the primary winding 40 is supported by the guide wall surface 68*a* and owing to the configuration thereof, it becomes possible to prevent the start terminal end 41*a* from approaching to the core center-leg portion 22. In particular, even if the start terminal end 41*a* is maintained in a loosened state, the start terminal end 41*a* is prevented from approaching to the core center-leg portion 22 by the guide wall surface 68*a* and therefore, it becomes possible to prevent a defect of electric discharge or the like from occurring in such a case in which the start terminal end 41*a* is arranged in close to the core center-leg portion 22.

In addition, in this exemplified embodiment, the guide wall surface 68*a* is provided at the guide wall portion 68 which protrudes toward the mounting substrate side (lower side: Z2 side) farther than the lower flange portion 62. Owing to this configuration, it becomes possible to design the inclined surface length of the guide wall portion 68 to be long, in which it is possible to separate the start terminal end 41*a* from the core center-leg portion 22 favorably.

Further, in this exemplified embodiment, on the lower face side of the terminal bed unit 65, there are provided guide groove portions 651 which are recessed toward the upper side. For this reason, it becomes possible to guide the start terminal end 41*a* favorably from the terminal member 70 to the winding-frame portion 66 by way of the guide wall surface 68*a*.

In addition, in this exemplified embodiment, the end portion (outer end portion) on the outside within the guide wall surface 68*a* is positioned on the lower side (Z2 side) compared with the groove bottom-surface 651*a* of the guide groove portion 651. For this reason, it becomes possible for the start terminal end 41*a* which is derived from the guide groove portion 651 to enter into the slit portion 67 in a state of being in close to the guide wall surface 68*a*.

In addition, on the outside apart from the middle barrel portion 63 within the guide wall portion 68, there is provided the outside straight wall surface 68*b* which extends toward the up and down directions (Z-direction). Further, the position on the upper end side of the outside straight wall surface 68*b* is positioned on the lower side compared with the position of the groove bottom-surface 651*a* of the guide groove portion 651 and concurrently, the position of the outside straight wall surface 68*b* in the X-direction is faced to the slit portion 67 within the guide groove portion 651, and also, is positioned on the middle barrel portion 63 side compared with the position of the corner portion 651*b* on the middle barrel portion 63 side. For this reason, it is possible to employ a constitution of bending the start terminal end 41*a* comparatively gently in the vicinity of the corner portion 651*b*. Therefore, in comparison with, for example, a constitution or the like in which the height position on the upper end side of the outside straight wall surface 68*b* is higher than the height position of the groove bottom-surface 651*a*, it is possible to prevent a rapidly-bent place from being formed at the start terminal end 41*a* and it becomes possible to prevent disconnection or the like of the start terminal end 41*a* from occurring.

In addition, by providing the outside straight wall surface 68*b*, it is possible to design the distance between the conductive wire 41 and the mounting substrate to be apart from each other. Owing to this configuration, it is possible to heighten the isolation-property between the transformer 10A and the mounting substrate. In addition, when comparing with the constitution in which the outside straight wall surface 68*b* does not exist, it becomes possible to prevent an acute-angled position from being formed at the guide wall portion 68. Owing to this configuration, it becomes possible to prevent a phenomenon that the start terminal end 41*a* may be in contact with the acute-angled position whereby disconnection thereof or peeling-off of the insulating coating may occur. In addition, owing to the existence of the outside straight wall surface 68*b*, it becomes possible to prevent a frangible acute-angled position from being formed. Further, when employing a molding using a resin, it becomes easy for the female slider, which is positioned inside the mold, to be pulled out and it becomes easy to carry out the molding.

In addition, in this exemplified embodiment, it is also possible for the distance in the up and down directions between the position on the upper end side and the position of the groove bottom-surface 651*a* to be set as one to three times of the diameter of the conductive wire 41 within the outside straight wall surface 68*b*. In case of employing a constitution like this, it becomes possible to derive the start terminal end 41*a*, which passed through the guide groove portion 651, toward the slit portion 67 more easily. In addition, when comparing with the constitution in which the outside straight wall surface 68*b* does not exist, it becomes possible to prevent an acute-angled position from being formed at the guide wall portion 68.

Second Exemplified Embodiment

Hereinafter, there will be explained a transformer 10B and a transformer-bobbin 60B which relate to a second exemplified embodiment of the present invention. It should be noted in this exemplified embodiment that identical reference numerals are used with regard to the portions which will take similar constitutions as those of the transformer 10A and the transformer-bobbin 60A in the first exemplified embodiment described above and concurrently, the explanations thereof will be omitted.

Figure 9:
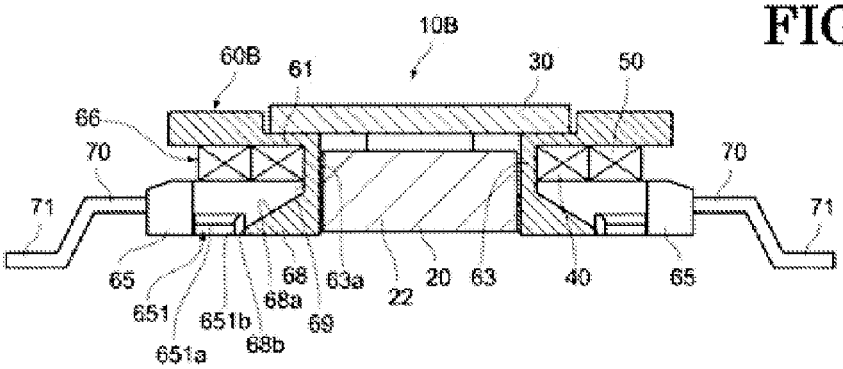
FIG. 9 is a cross-sectional side view showing a constitution of a transformer relating to a second exemplified embodiment.
Figure 9:
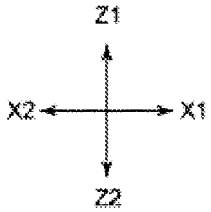

FIG. 9 is a cross-sectional side view showing a constitution of a transformer 10B relating to a second exemplified embodiment. It should be noted in FIG. 9 that the illustration of the conductive wire 41 (including the start terminal end 41*a*) was omitted. As shown in this FIG. 9, this exemplified embodiment is a little bit different in its constitution of the transformer-bobbin 60B. Specifically, at the slit portion 67 within the transformer-bobbin 60B, there is provided an inside straight wall surface 69. The inside straight wall surface is a portion which extends upward from the inner end portion (end portion on the middle barrel portion 63 side) of the guide wall surface 68*a* and is a portion which goes along the outer surface of the middle barrel portion 63.

It should be noted that the guide wall surface 68*a* in the transformer-bobbin 60B of this exemplified embodiment is constituted such that the inclination angle thereof becomes gentle compared with that of the guide wall surface 68*a* in the transformer-bobbin 60A of the first exemplified embodiment. However, it is allowed to employ a constitution in which the inclination angles of the both surfaces become equivalent.

By providing such an inside straight wall surface at the transformer-bobbin 60B, the guide wall surface 68*a* of this exemplified embodiment becomes in a state of being positioned on the lower side compared with the guide wall surface 68*a* of the first exemplified embodiment. Therefore, according to this exemplified embodiment, it is possible for the distance between the start terminal end 41*a* which extends from the primary winding 40 and the secondary winding 50 to be secured largely compared with the distance between the start terminal end 41*a* and the secondary winding 50 in the constitution of the first exemplified embodiment, in which it is possible to improve isolation-property between the start terminal end 41*a* and the secondary winding 50 furthermore.

Modified Example

As described above, there was explained one exemplified embodiment of the present invention, but the present invention is configured such that it is possible to employ various kinds of modifications other than that embodiment. Hereinafter, this matter will be described.

In the above-mentioned exemplified embodiment, the outside away from the terminal bed unit 65 within the slit portion 67 is provided to be opened. More specifically, the slit portion 67 is provided in a shape which is slit from the outside.

However, it is allowed for the outside of the slit portion 67 to have a constitution to be blocked from the outside. Even in this case, the slit portion 67 exists inside the terminal bed unit 65 and if this slit portion 67 communicates with the guide groove portion 651, it is possible to exert a similar action effect as that of the transformer-bobbins 60A, 60B described above.

In addition, in the above-mentioned exemplified embodiment, there was explained a wall surface in which the guide wall surface 68*a* is provided in a taper shape and also in a planar shape. However, the guide wall surface 68*a* is not limited by the taper shape or by the planar shape either. For example, it is allowed for the guide wall surface 68*a* to have a curved-surface shape and also, it is allowed for the corner portion thereof to have a step shape which is formed in an R-surface shape.

In addition, in the above-mentioned exemplified embodiment, the terminal bed unit 65 is provided integrally with the lower flange portion 62. However, it is allowed to employ a constitution in which the terminal bed unit 65 is provided separately from the lower flange portion 62.

In addition, in the above-mentioned exemplified embodiment, there was explained a constitution (EI-type) which uses an E-type core 20 and a lid core 30 as for the core. However, the core which is used in the present invention is not limited by these elements. For example, it is allowed to use two E-type cores and it is also allowed to use cores having other shapes by combining them appropriately.

In addition, in the above-mentioned exemplified embodiment, it is constituted such that the primary winding 40 is positioned on the inner diameter side of the winding-frame portion 66 and the secondary winding 50 is positioned on the outer diameter side of the winding-frame portion 66. However, it is allowed to employ a constitution in which the secondary winding 50 is positioned on the inner diameter side of the winding-frame portion 66 and the primary winding 40 is positioned on the outer diameter side of the winding-frame portion 66. In this case, the start terminal end 41*a* becomes the terminal end of the conductive wire 41 which constitutes the secondary winding 50.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A transformer-bobbin comprising:

a middle barrel portion having an insertion hole through which a core unit is inserted;

a lower flange portion which is provided by protruding toward a direction apart from the axis-line center of the middle barrel portion and concurrently which is positioned on a side, within the middle barrel portion, that is mounted on a mounting substrate;

an upper flange portion which is provided by protruding toward a direction apart from the axis-line center of the middle barrel portion and concurrently which is positioned on a side, within the middle barrel portion, that is apart from the mounting substrate; and a terminal bed unit which is provided integrally or separately with the lower flange portion and concurrently which supports the terminal member, and further comprising: a winding-frame portion constituted by the middle barrel portion, the lower flange portion and the upper flange portion, wherein there is provided a slit portion which notches the terminal bed unit and the lower flange portion and concurrently which extends in the centrally approaching and separating direction toward the middle barrel portion side, and wherein at the slit portion, there is provided a guide wall surface whose side on the middle barrel portion side is positioned on the lower flange portion side compared with whose side apart from the middle barrel portion.

2. The transformer-bobbin according to claim 1, wherein on the guide wall surface, there is provided a guide wall portion which protrudes toward the mounting substrate side compared with the lower flange portion.

3. The transformer-bobbin according to claim 1, wherein on the facing-surface side which faces to the mounting substrate within the terminal bed unit, there is provided a guide groove portion which recesses, compared with the facing-surface, toward the side apart from the mounting substrate and concurrently which is for guiding the conductive wire wound around the winding-frame portion to the terminal member.

4. The transformer-bobbin according to claim 1, wherein the outer end portion which is an end portion apart from the middle barrel portion in the centrally approaching and separating direction within the guide wall surface is positioned on the mounting substrate side compared with the position of the groove bottom-surface of the guide groove portion in the substrate approaching and separating direction apart from the mounting substrate.

5. The transformer-bobbin according to claim 4, wherein on the side apart from the middle barrel portion within the guide wall portion, there is provided an outside straight wall surface which extends in the substrate approaching and separating direction apart from the mounting substrate and concurrently which is connected with the outer end portion, wherein the position of the end portion side which is apart from the mounting substrate in the substrate approaching and separating direction within the outside straight wall surface is positioned on the mounting substrate side compared with the position of the groove bottom-surface of the guide groove portion in the substrate approaching and separating direction, and wherein in addition, the position of the outside straight wall surface in the centrally approaching and separating direction is faced to the slit portion within the guide groove portion and also is positioned on the middle barrel portion side compared with the position of the corner portion on the middle barrel portion side.

6. The transformer-bobbin according to claim 5, wherein the distance in the approaching and separating direction of the substrate is a distance lying between the position on the end portion side apart from the mounting substrate and the position of the groove bottom-surface of the guide groove portion within the outside straight wall surface and is set as one to three times of the diameter of the conductive wire.

7. A Transformer using the transformer-bobbin according to claim 1 comprising:

a primary winding which is arranged at the winding-frame portion and concurrently which is positioned on the middle barrel portion side, and a secondary winding which is arranged at the winding-frame portion and concurrently which is positioned on the outside of the primary winding.

8. The transformer-bobbin according to claim 1, wherein the inner end portion on the middle barrel portion side within the guide wall surface is apart from the winding-frame portion side within the lower flange portion and concurrently, between the inner end portion and the winding-frame portion side of the lower flange portion, there exists an inside straight wall surface along the outer surface of the middle barrel portion.

9. The transformer-bobbin according to claim 8, wherein on the guide wall surface, there is provided a guide wall portion which protrudes toward the mounting substrate side compared with the lower flange portion.

10. The transformer-bobbin according to claim 8, wherein on the facing-surface side which faces to the mounting substrate within the terminal bed unit, there is provided a guide groove portion which recesses, compared with the facing-surface, toward the side apart from the mounting substrate and concurrently which is for guiding the conductive wire wound around the winding-frame portion to the terminal member.

11. The transformer-bobbin according to claim 8, wherein the outer end portion which is an end portion apart from the middle barrel portion in the centrally approaching and separating direction within the guide wall surface is positioned on the mounting substrate side compared with the position of the groove bottom-surface of the guide groove portion in the substrate approaching and separating direction apart from the mounting substrate.

12. The transformer-bobbin according to claim 11, wherein on the side apart from the middle barrel portion within the guide wall portion, there is provided an outside straight wall surface which extends in the substrate approaching and separating direction apart from the mounting substrate and concurrently which is connected with the outer end portion, wherein the position of the end portion side which is apart from the mounting substrate in the substrate approaching and separating direction within the outside straight wall surface is positioned on the mounting substrate side compared with the position of the groove bottom-surface of the guide groove portion in the substrate approaching and separating direction, and wherein in addition, the position of the outside straight wall surface in the centrally approaching and separating direction is faced to the slit portion within the guide groove portion and also is positioned on the middle barrel portion side compared with the position of the corner portion on the middle barrel portion side.

13. The transformer-bobbin according to claim 12, wherein the distance in the approaching and separating direction of the substrate is a distance lying between the position on the end portion side apart from the mounting substrate and the position of the groove bottom-surface of the guide groove portion within the outside straight wall surface and is set as one to three times of the diameter of the conductive wire.

* * * * *